United States Patent [19]

Weiss et al.

[11] 4,033,514

[45] July 5, 1977

[54] APPARATUS FOR BUILDING UP AND REPAIRING A REFRACTORY LINING

[75] Inventors: Franz Weiss, Vienna; Friedrich Baumgartner; Werner Zach, both of Dorf-Veitsch, all of Austria

[73] Assignee: Veitscher Magnesitwerke-Actien-Gesellschaft, Vienna, Austria

[22] Filed: Nov. 10, 1975

[21] Appl. No.: 630,187

[30] Foreign Application Priority Data

Nov. 11, 1974 Austria ..... 8997/74

[52] U.S. Cl. ..... 239/662; 239/683; 239/687; 266/281

[51] Int. Cl.[2] ..... B05B 3/10

[58] Field of Search ..... 266/43, 1 R, 281; 239/224, 665, 666, 432, 662, 681, 683, 687

[56] References Cited

UNITED STATES PATENTS

| | | | |
|---|---|---|---|
| 3,374,956 | 3/1968 | Bazilli et al. | 239/683 |
| 3,406,915 | 10/1968 | Dreyer | 239/683 |
| 3,441,225 | 4/1969 | Cotter et al. | 239/687 X |
| 3,469,718 | 9/1969 | Felix et al. | 239/687 X |
| 3,760,933 | 9/1973 | Maldeis et al. | 239/662 X |

FOREIGN PATENTS OR APPLICATIONS

| | | | |
|---|---|---|---|
| 1,217,414 | 5/1966 | Germany | 266/281 |

*Primary Examiner*—Evon C. Blunk
*Assistant Examiner*—Michael Mar
*Attorney, Agent, or Firm*—Kurt Kelman

[57] ABSTRACT

An apparatus for building up and repairing a refractory lining of an industrial oven or like hot-running vessel comprises a disc rotatable in a horizontal plane for centrifugally depositing a granular refractory material on a portion of the lining to be built up or repaired. A conduit feeds the material to the disc and a stationary cover is mounted over the outlet opening of the conduit and has outlet ports distributed about its circumference. The ports may be selectively closed.

8 Claims, 3 Drawing Figures

APPARATUS FOR BUILDING UP AND REPAIRING A REFRACTORY LINING

The present invention relates to improvements in an apparatus for building up and repairing a refractory lining of an industrial oven or like hot-running vessels by centrifugally depositing a granular refractory material, such as burnt magnesite or dolomite, on a portion of the lining to be built up or repaired, and more particularly to such an apparatus wherein a disc extending in a horizontal plane and rotatable in the plane may be lowered into the oven or vessel to direct the granular material to such a lining portion by feeding the material through an outlet opening in a conduit above the disc and rotating the disc to deposit the material centrifugally on the lining portion.

An apparatus of this type has been disclosed in German Pat. No. 1,217,414. In this known apparatus, the outlet of the funnel-shaped conduit for the refractory material is closed by a frusto-conical hood which is connected to radiating ribs of the rotatable disc. Lateral baffles or shields are provided along selected circumferential portions of the hood so that the granular material may be centrifugally entrained by the rotating disc only through the open portions of the circumference which are not shielded. By suitably selecting the shielded and open portions, selected sectors of the lining may be built up or repaired. This is particularly advantageous in the repair of arc furnaces where the portions of the lining adjacent the electrodes are most rapidly worn out.

This known apparatus has the disadvantage that it cannot be used with wetted refractory materials. Furthermore, the known apparatus does not make it possible to deposit different amounts of refractory material on the respective lining sectors. This is very useful particularly in arc furnaces since the lining portion adjacent one of the electrodes is worn out much more quickly than in other portions. Finally, it is difficult in the known apparatus to adjust the shielding and thus to adapt the apparatus to different operating conditions.

It is the primary object of this invention to provide an apparatus of the indicated type which is free of the disadvantages of the known apparatus and which makes it possible in a simple manner to repair selectively lining sectors of differing extensions and wear, and with granular refractory materials which are wetted with a liquid. It is another object of the invention to provide such an apparatus which may be inserted into the hot oven or vessel, preferably immediately after tapping the last charge.

The above and other objects are accomplished according to the present invention by placing a stationary cover means or shield over the outlet opening of the feeding conduit for the granular refractory material, the cover means having circumferentially distributed outlet ports directed towards the centrifugal disc, and means for closing the outlet ports.

In this improved apparatus, the granular material is gravity-fed through the outlet ports of the shield in loose form to the rotating disc and is centrifugally and selectively thrown against the portions of the lining to be repaired. If the outlet ports are relatively close to the axis of rotation of the disc, sectors of relatively large extension may be repaired while the granular material will be deposited in very finely comminuted form. This arrangement may even be used to repair a circular lining portion. However, if lining sectors of small extension are to be repaired, outlet ports near the circumference of the shield are used. Thus, it is preferred to arrange the outlet ports in the cover means radially movable. If the outlet ports are changeable in size, the amounts of deposited material per arcuate unit of repaired lining may be controlled, which makes it possible not only to repair lining sectors of different dimensions but also sectors of different depth.

The above and other objects, advantages and features of this invention will become more apparent from the following detailed description of a now preferred embodiment thereof, taken in conjunction with the accompanying drawing wherein FIG. 1 is a side elevational view of an apparatus according to the invention;

Figure 1:
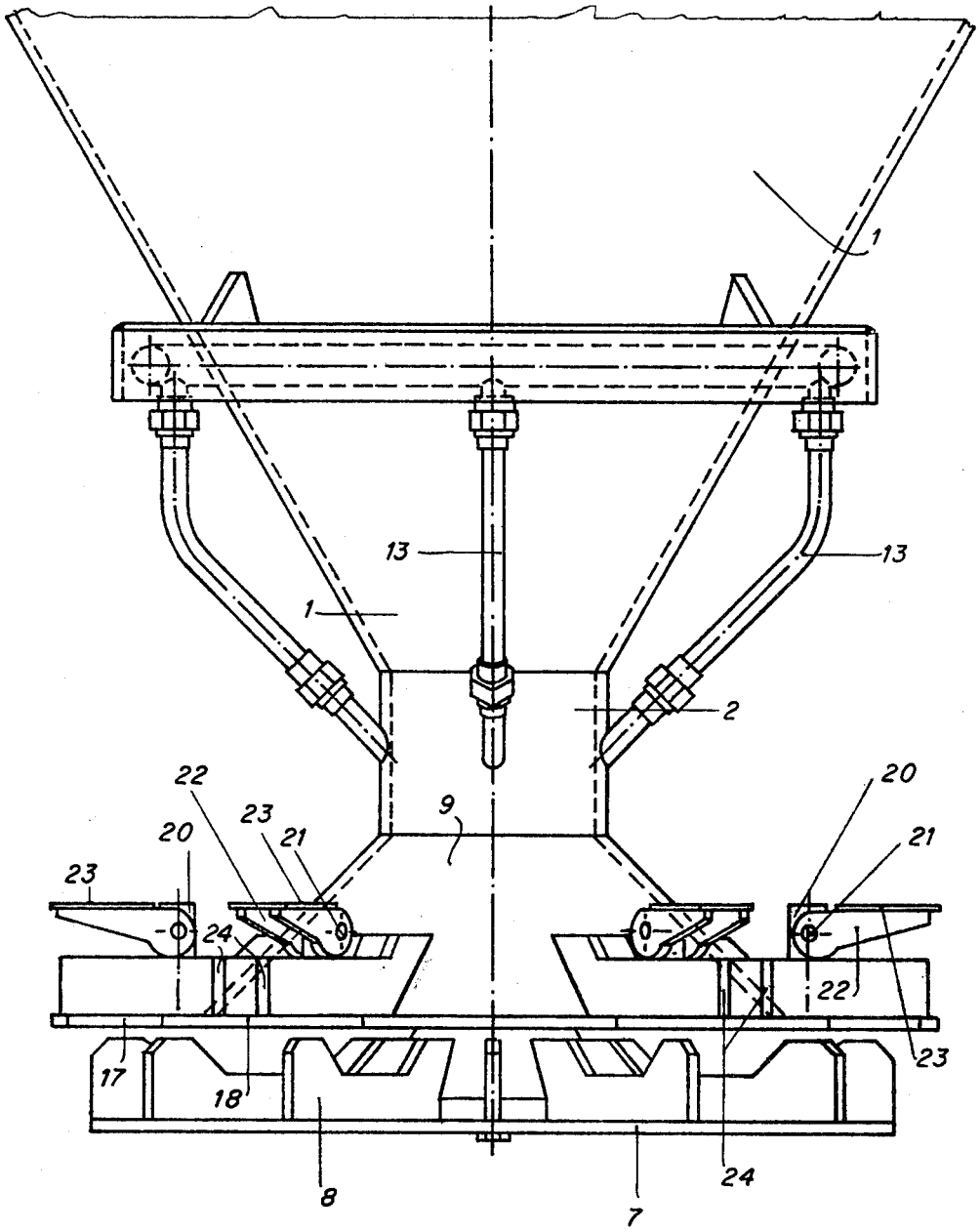

Referring now to the drawing, there is shown funnel-shaped hopper 1 through which a granular refractory material is to be fed, the narrow end of the hopper being connected to one end of cylindrical pipe 2 whose other end is connected to frusto-conically enlarged conduit 3 of annular cross-section and having annular outlet opening 4. Vertical drive shaft 5 is mounted in bearing 6 and extends coaxially through the feed hopper and conduit, disc 7 being keyed to the drive shaft. Ribs 8 radiate from the hub of the disc and divide the same into a plurality of sectors. The end of the drive shaft opposite to the end carrying disc 7 is connected to a drive motor (not shown), which may be a pneumatically operated motor, to rotate the disc at about 700 to 800 rpm, for example.

Refractory material feed conduit 3 is defined by stationary frusto-conical wall 9 connected to pipe 2 and concentrically arranged frusto-conical wall 10 connected to drive shaft 5 for rotation therewith. The drive shaft furthermore carries conveyor screw 11 extending from the lower portion of hopper 1 and through cylindrical pipe 2. If desired, this conveyor screw may extend downwardly into the conduit 3 but, in the illustrated embodiment, conveyor vanes 12 are mounted on wall 10. Such an arrangement will serve to convey the granular material to the annular feed conduit and to mix the material with a wetting liquid in the conduit, which wetting liquid, such as water, is fed to the conduit through conduit tubing 13.

Figure 3:
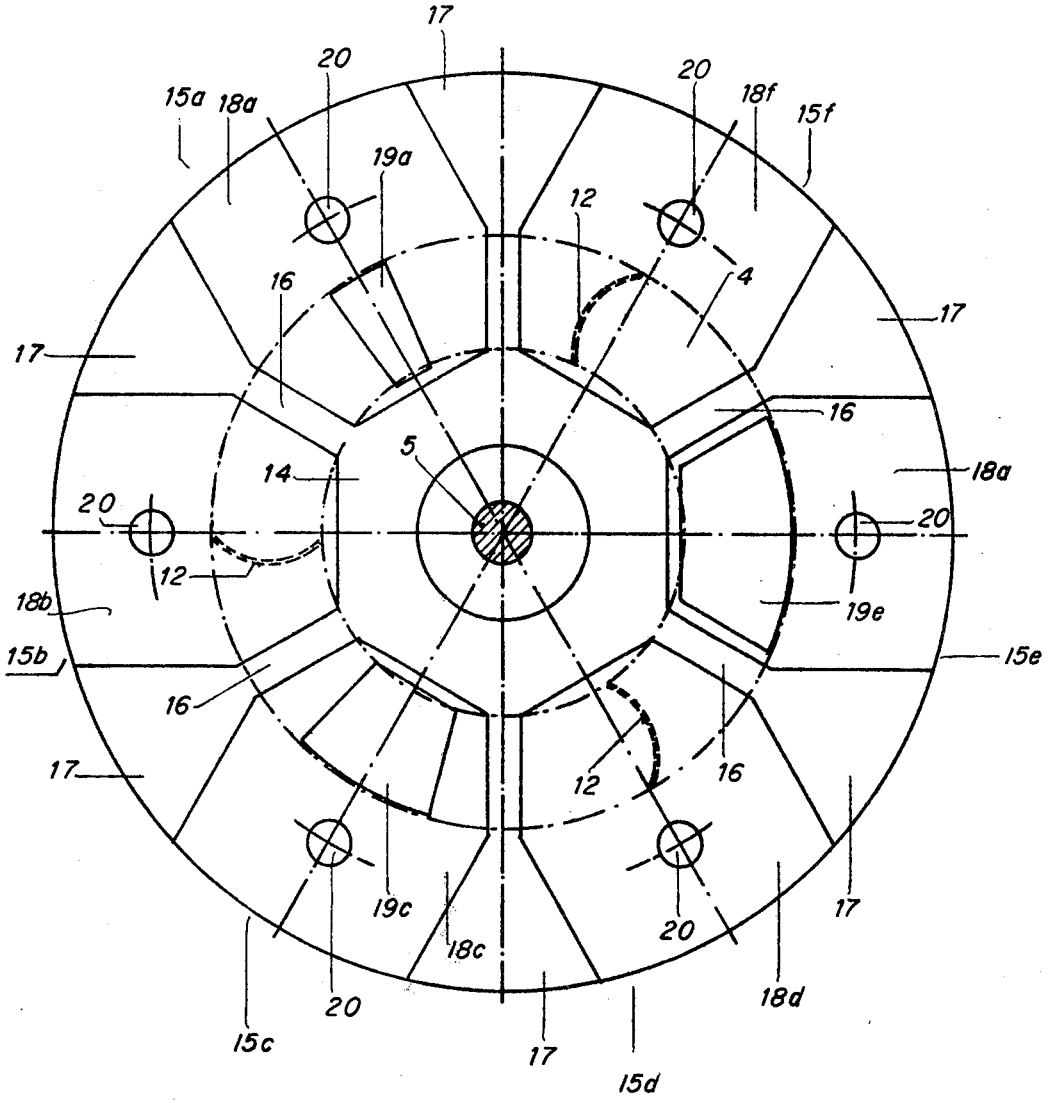
FIG. 3 is a view along line III—III of FIG. 2.

Stationary cover or shield 14 is mounted between annular outlet opening 4 of feed conduit 3 and rotatable disc 7. The cover is star-shaped and has six outlet ports 15*a* to 15*f* distributed circumferentially and defined by radially extending cut-outs or sectors which are open towards the periphery. The outlet port sectors are defined between narrow, radially extending webs 16 projecting from the hub of the cover and ending towards the periphery in triangularly flaring cover portions 17, as shown in FIG. 3. Sliding plates 18*a* to 18*f* are inserted into the outlet port cutouts for closing the outlet ports.

As illustrated in FIG. 3, alternate sliding closure plates 18*a*, 18*c* and 18*e* have ports 19*a*, 19*c* and 19*e* in registry with annular outlet opening 4 of feed conduit 3. Interleaved sliding closure plates 18*b*, 18*d* and 18*f* are solid, i.e. they have no ports, so that they completely close off outlet ports 15*b*, 15*d* and 15*f* when slid into place and thus prevent any granular material to be fed from conduit 3 to rotating disc 7, the outlet opening of the conduit being shown in FIG. 3 in chain-dotted lines.

Figure 2:
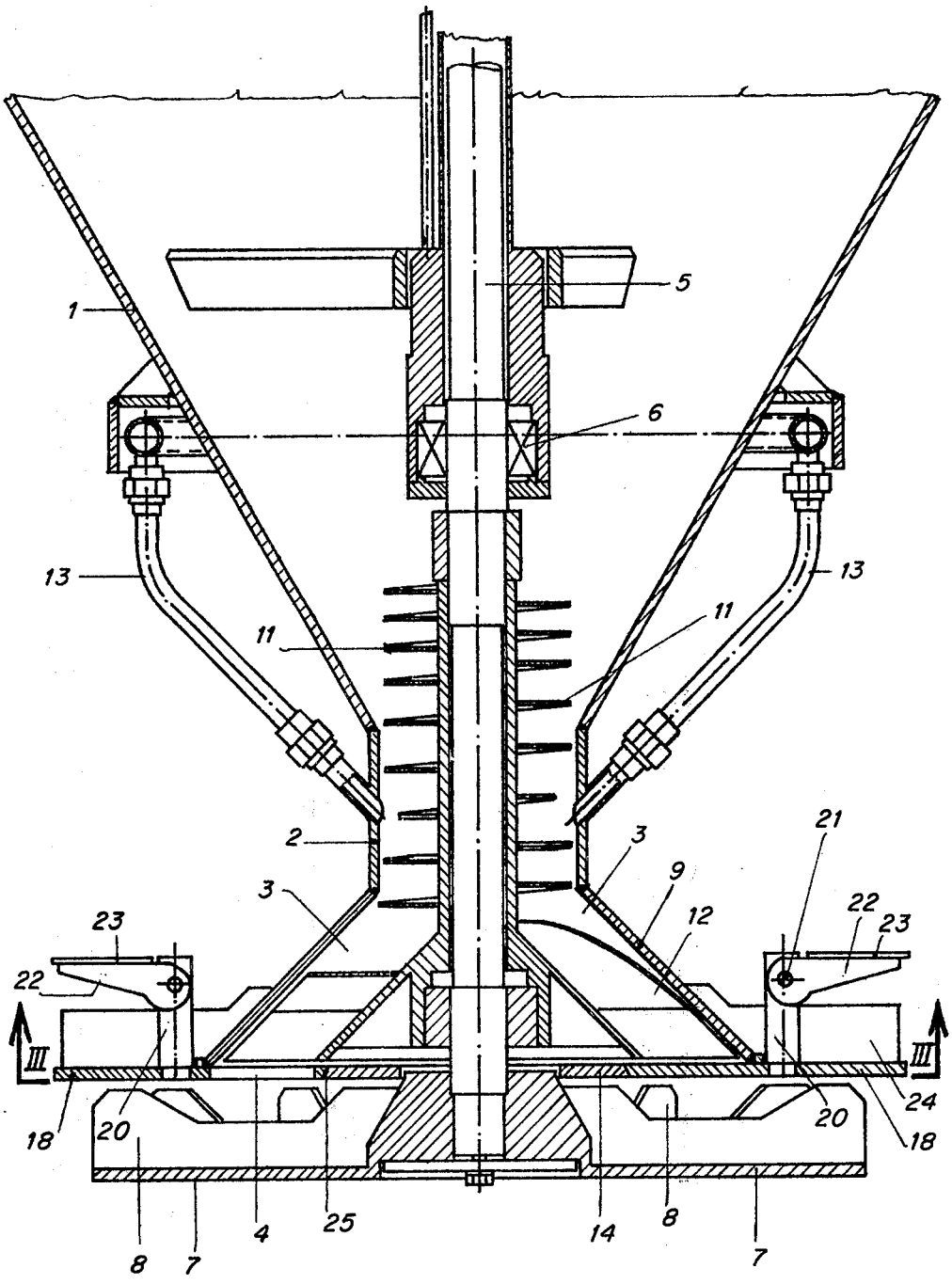
FIG. 2 is an axial section of the apparatus of FIG. 1.

Each sliding closure plate has a bolt or stud 20 carrying pivot 21 of a pair of levers 22 provided with eccenter cams and interconnected by plate 23 into a lever unit. The cams of the levers contact a pair of radial ribs 24 projecting radially from wall 9 of conduit 3, as best seen in FIGS. 1 and 2. This arrangement enables the sliding closure plates to be pressed against ribs 24 and the lower rim of conduit wall 9 and thus to hold the plates in cover 14. Proper engagement is assured by correspondingly and matchingly beveling inner edges 25 of plates 18 and the adjacent edges of outlet port cut-outs 15. The sliding plates may be lowered out of the plane of cover 14 by pivoting levers 22 and may then be radially moved out of the cover.

Obviously, other means, such as screw connections, may be used for holding and moving the sliding plates in the cover, such as using threaded bolts 20 cooperating with a nut, wedge-shaped connections or like means.

The above-described arrangement makes it possible readily to change the sliding closure plates and to provide plates with different outlet ports to adapt the apparatus to different operating conditions. By increasing the cross section of feed conduit 3 in the region of cover 14, the granular material fed to the disc will be loosened and conglomeration of the material will thus be reduced or prevented.

The above-described apparatus operates in the following manner:

The apparatus is transported to the hot oven or vessel by an overhead crane and lowered into the oven or vessel to a level predetermined by the level at which the lining is to be repaired. Once in position, the drive motor for shaft 5 is turned on and refractory granular material is fed into hopper 1, while water or any other suitable wetting liquid is fed through conduits 13. Turning conveyor screw 11 will convey the granular material downwardly and through pipe 2 into conduit 3 where blades 12 will mix the granular material with the liquid to wet the material and move the wetted material to outlet opening 4. The wetted material will then be gravity-fed through outlet ports 19 in the sliding plates to rotating disc 7. Due to the enlargement of the cross section of the feed conduit from cylindrical section 2 to conically flaring section 3, no congestion of the material will occur at the outlet and stopping up of the outlet ports will be prevented. The wetted refractory material will always be fed to the rotating disc in loose form. As the material reaches the disc, it will be centrifugally thrown outwardly towards the lining and there deposited by centrifugal force.

Maximal supply of refractory material all around the lining may be obtained by opening all outlet port cut-outs 15 to the maximum. This may be readily achieved simply by sliding all closure plates 18 radially outwardly until they fully uncover annular outlet opening 4 of conduit 3. If desired, the closure plates may be entirely removed but this entails the danger of encrustation of the slideway edges of ports 15 with refractory material, which may then hinder the ready insertion and sliding plates in a subsequent operation. Therefore, when maximum deposition all around the lining in a circular band is desired, closure plates with maximum size ports are used, as is shown in FIG. 3 in connection with cut-out **15*e* in which slidable plate 18*e* is inserted, this plate defining large outlet port 19*e*. On the other hand, if only relatively small sectors of the lining are to be repaired, a corresponding number of closure plates without any outlet port are inserted in corresponding cut-outs in cover 14. The various requirements may be further met by suitably arranging the outlet ports 19 at different radial distances from drive shaft 5, which may be readily done simply by sliding the closure plates, and/or by suitably selecting the sizes of ports 19, such as shown at 19*a* and 19*c***. Any of these changes will correspondingly modify the arcuate extent of the deposition of the granular refractory material on the inner wall of the oven or vessel and/or the amount of such deposition by centrifugal force, thus assuring a simple control of the operation to adapt the apparatus to the repair of different sized lining sectors and/or repairs of different depths due to differential wear of the lining.

The apparatus is particularly useful for repairs of ovens and vessels of circular cross section, such as arc furnaces, oxygen converters, ladles and the like but it may be used for any type of hot-running oven, furnace or vessel requiring repairs of a refractory lining.

What is claimed is:

1. For use in an industrial oven or like hot-running vessel having a vertically extending refractory lining and an apparatus for building up and repairing the lining, the apparatus comprising a disc extending in a horizontal plane and rotatable in the plane for centrifugally depositing a granular refractory material on a portion of the lining to be built up or repaired, a conduit for feeding the granular refractory material to the disc, the conduit having an outlet opening above the disc, a stationary cover means over the outlet opening, the cover means having circumferentially distributed outlet ports directed towards the centrifugal disc, and plates slidable into and out of the outlet ports in a radial direction for changing the size and closing the outlet ports.

2. In the combination of claim 1, the conduit having an enlarged cross section in the region of the cover means.

3. In the combination of claim 1, the conduit having an annular cross section, a drive shaft for the centrifugal disc coaxially arranged within the conduit, the conduit conically flaring outwardly in the direction of the outlet opening and the outlet opening being annular, and the outlet ports in the cover means having the shape of ring sectors.

4. In the combination of claim 1, means for conveying the granular refractory material arranged in the conduit.

5. In the combination of claim 1, means for mixing the granular refractory material arranged in the conduit.

6. In the combination of claim 1, conduit means attached to the conduit for feeding a wetting liquid for the granular refractory material into the conduit.

7. In the combination of claim 1, at least some of the outlet ports being defined by radially extending cut-outs in the cover means.

8. In the combination of claim 7, the slidable plates defining outlet ports.

* * * * *